US010786046B2

(12) United States Patent
Woodward

(10) Patent No.: US 10,786,046 B2
(45) Date of Patent: Sep. 29, 2020

(54) FASTENING DEVICE FOR FOOTWEAR

(71) Applicant: William Woodward, Baltimore, MD (US)

(72) Inventor: William Woodward, Baltimore, MD (US)

( * ) Notice: Subject to any disclaimer, the term of this patent is extended or adjusted under 35 U.S.C. 154(b) by 171 days.

(21) Appl. No.: 15/442,629

(22) Filed: Feb. 25, 2017

(65) Prior Publication Data

US 2017/0245596 A1 Aug. 31, 2017

Related U.S. Application Data

(60) Provisional application No. 62/301,234, filed on Feb. 29, 2016.

(51) Int. Cl.
*A43C 11/00* (2006.01)
*A43B 23/24* (2006.01)
(Continued)

(52) U.S. Cl.
CPC ..... *A43C 11/008* (2013.01); *A43B 23/24* (2013.01); *A43C 11/004* (2013.01); *A43C 11/12* (2013.01); *A43C 11/146* (2013.01); *A43C 11/1493* (2013.01); *A43B 3/122* (2013.01); *A43B 3/126* (2013.01); *A43C 1/04* (2013.01); *A43C 1/06* (2013.01); *A43C 7/00* (2013.01); *A43C 9/06* (2013.01); *A43C 11/002* (2013.01); *A43C 11/02* (2013.01); *A43C 11/04* (2013.01); *A43C 11/06* (2013.01); *A43C 11/08* (2013.01); *A43C 11/10* (2013.01); *A43C 11/14* (2013.01);
(Continued)

(58) Field of Classification Search
CPC ... A43C 11/002; A43C 11/004; A43C 11/008; A43C 11/02; A43C 11/04; A43C 11/06; A43C 11/08; A43C 11/10; A43C 11/12; A43C 11/14; A43C 11/142; A43C 11/146; A43C 11/1446; A43C 11/1493; A43C 11/148; A43C 11/22; A43C 11/24; A43C 1/04; A43C 1/06; A43C 9/06; A43C 7/00; A43B 23/24; A43B 3/122; A43B 3/126; Y10T 24/3742
USPC ..... 2/245; 24/301, 712.4; 36/136, 117.7, 36/118.2
See application file for complete search history.

(56) References Cited

U.S. PATENT DOCUMENTS 660,680 A * 10/1900 Conn ..... A43C 11/22 24/575.1
709,536 A * 9/1902 Crane ..... A43C 11/148 24/596.1
(Continued)

*Primary Examiner* — Timothy K Trieu
*Assistant Examiner* — Dakota Marin
(74) *Attorney, Agent, or Firm* — Ellenoff Grossman & Schole LLP; James M. Smedley; Alex Korona

(57) ABSTRACT

A shoe fastening system designed to engage the eyelet holes of a shoe, comprising, an anchor, wherein the anchor has a first end and a second end, wherein the first end has means to detachably engage with an eyelet of a shoe and the second end has a connection means, an attachment member having a first end and a second end, wherein the first end is designed to securely fit within the connection means of the anchor and the second has a closed loop, a strap, wherein the strap is sized to fit through the closed loop of the attachment member and is a predetermined length and width, and a locking mechanism fitted to receive the strap and engage the strap to keep the strap at a specific length.

17 Claims, 8 Drawing Sheets

(51) Int. Cl.

| | |
|---|---|
| ***A43C 11/14*** | (2006.01) |
| ***A43C 11/12*** | (2006.01) |
| *A43C 11/08* | (2006.01) |
| *A43C 11/24* | (2006.01) |
| *A43C 11/10* | (2006.01) |
| *A43C 1/04* | (2006.01) |
| *A43C 11/04* | (2006.01) |
| *A43C 11/02* | (2006.01) |
| *A43C 7/00* | (2006.01) |
| *A43C 9/06* | (2006.01) |
| *A43B 3/12* | (2006.01) |
| *A43C 11/06* | (2006.01) |
| *A43C 11/22* | (2006.01) |
| *A43C 1/06* | (2006.01) |

(52) U.S. Cl.
CPC ..... *A43C 11/142* (2013.01); *A43C 11/148* (2013.01); *A43C 11/1446* (2013.01); *A43C 11/22* (2013.01); *A43C 11/24* (2013.01); *Y10T 24/3742* (2015.01)

(56) References Cited

U.S. PATENT DOCUMENTS 710,439 A * 10/1902 Dice ..... A44B 17/0011 24/669
752,149 A * 2/1904 Geer ..... A41F 3/02 2/342
758,787 A * 5/1904 Shorten ..... A43C 11/22 24/575.1
1,053,529 A * 2/1913 Neary ..... A43C 5/00 24/703.3
1,094,357 A * 4/1914 Ayres ..... A43C 3/02 24/713.5
1,246,724 A * 11/1917 Daggett ..... A43C 5/00 24/715.1
1,409,069 A * 3/1922 Smith ..... A44B 17/0011 24/669
1,640,104 A * 8/1927 Stafford ..... A43C 11/14 2/245
1,660,664 A * 2/1928 Aleksandrowicz .. A43C 11/004 36/50.1
2,284,814 A * 6/1942 Gookin ..... A43C 5/00 24/715.1
3,205,544 A * 9/1965 Streule ..... A43C 11/1493 24/306
4,470,175 A * 9/1984 Chiarella ..... A43C 11/1413 24/70 SK
4,633,548 A * 1/1987 Siskind ..... A43C 1/00 24/687
4,790,048 A * 12/1988 Arnt ..... A43C 7/00 24/712.1
4,879,787 A * 11/1989 Walls ..... A43B 3/0078 24/712.2
4,907,352 A * 3/1990 Ginsberg ..... A43C 11/1493 12/113
5,148,614 A * 9/1992 Kelly ..... A43B 11/00 36/1
5,313,669 A * 5/1994 Rasdell ..... A41F 17/00 2/107
5,526,585 A * 6/1996 Brown ..... A43B 11/00 36/50.1
5,649,342 A * 7/1997 D'Andrade ..... A43C 7/005 24/712.2
5,845,371 A * 12/1998 Chen ..... A43C 11/1406 24/71 SK
5,894,640 A * 4/1999 Dewey ..... A43C 11/00 24/306
5,913,483 A * 6/1999 Polk ..... A43B 3/0078 24/306
6,256,906 B1 * 7/2001 Matis ..... A43B 3/126 36/11.5
6,546,649 B1 * 4/2003 Tobias ..... A43B 3/0078 36/112
7,066,179 B2 * 6/2006 Eaton ..... A61M 16/0683 128/202.27
7,404,242 B1 * 7/2008 Perler ..... A43B 3/0078 2/245
7,793,436 B2 * 9/2010 Sink ..... A43B 3/122 24/300
7,866,008 B2 * 1/2011 Laks ..... A43C 11/06 24/614
8,516,725 B1 * 8/2013 George ..... A43C 11/16 24/714.8
9,259,055 B1 * 2/2016 Raynor ..... A43C 7/04
2001/0032378 A1 * 10/2001 Burt ..... A43C 11/1406 24/307
2003/0221334 A1 * 12/2003 McFee ..... A43C 11/16 36/50.1
2004/0072482 A1 * 4/2004 Runyan ..... A43B 3/103 441/70
2005/0257353 A1 * 11/2005 Rohrig ..... A45F 5/02 24/537
2006/0010721 A1 * 1/2006 Valko ..... A43B 3/0078 36/136
2007/0099469 A1 * 5/2007 Sorensen ..... A45F 5/02 439/289
2007/0169382 A1 * 7/2007 Bongard ..... A43C 7/00 36/136
2008/0086917 A1 * 4/2008 Carrillo ..... A43B 3/0078 36/136
2010/0205789 A1 * 8/2010 Labelson ..... A44B 11/006 24/458
2012/0246972 A1 * 10/2012 Newkirk ..... A43C 11/004 36/50.1
2013/0263473 A1 * 10/2013 Young ..... A43C 11/22 36/83
2015/0074949 A1 * 3/2015 Tsai ..... A44B 15/00 24/3.12
2015/0366294 A1 * 12/2015 Riccardi ..... A43B 23/24 36/136

* cited by examiner

FASTENING DEVICE FOR FOOTWEAR

BACKGROUND OF THE INVENTION

The present invention relates to a replacement for shoe laces, and more particularly to shoe fastening system 1 that is easy to attached and detach and customizable by the wearer.

Shoes have become a major part of ones outfit in recent times as fashion as crossed the world. One area of the shoe that has not gotten as much attention are the laces. While the laces on most shoes remain the string that is sent through the loops, the only real variation to this is the color or the material the laces are made out of.

Other forms of fastening shoes such as hook and loop fasteners, buckles, and clasps have been used but do not have the same aesthetically pleasing look as the laces do. In most cases, the elastic straps on current market (ends are permanently attached to the body of the shoe) cannot be removed to be replaced when the elastic become defective, cut, slit, or discolored. While the laces are easy to replace they are they do not add any features to the shoe.

However, the laces and other forms of shoe fastening methods and devices do not leave a lot for the wearer to customize the look of the shoe. Therefore there is a need for a fastening device that allows the wearer to customize the shoe in various ways and provide an alternative method of fastening ones shoe with ease.

SUMMARY

Aspects of an embodiment of the present invention disclose a shoe fastening system designed to engage the eyelet holes of a shoe, comprising an anchor, wherein the anchor has a first end and a second end, wherein the first end has means to detachably engage with an eyelet of a shoe and the second end has a connection means. An attachment member having a first end and a second end, wherein the first end is designed to securely fit within the connection means of the anchor and the second has a closed loop. A strap, wherein the strap is sized to fit through the closed loop of the attachment member and is a predetermined length and width. A locking mechanism fitted to receive the strap and engage the strap to keep the strap at a specific length.

Another aspect of the present invention is a shoe fastening system designed to retrofit into a shoe with a plurality of holes, comprising an anchor comprising, a body having a first end and a second end, wherein the first end of the body has a predetermined shaped groove, a cover flap having a first end and second end, wherein the first end of the cover flap is attached to the body at the second end and an open is present distal to the second end of the cover flap, a backing flap having a first end and second end, wherein the first end of the backing flap is attached to the second end of the body and an opening is present distal to the second end of the backing flap, a pin is secured to the opening of the backing flap, and sized to securely fit through the opening of the cover flap. A strap comprising, a first latch having a first end and second end, wherein the first end has an extension sized to fit within the groove of the body of the anchor, and the second end has an opening, a band of a predetermined length, sized to fit through the opening of the first latch, and a second latch having a first end and a second end, wherein the first end has an extension sized to fit within the groove of the body of the anchor, and the second end has an opening which the band passes through.

DETAILED DESCRIPTION OF THE INVENTION

The products of the present invention provide a shoe fastening device and method of using that allow users with various handicaps to easily and independently fasten their shoes, and also allows the opportunity for wearers to customize their shoes. The device is a replacement for laces, hook and loop fasteners, clasps, and buckles and provides an easy method of fastening shoes based on the wearers desires.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. It is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any methods and materials similar or equivalent to those described herein may also be used in the practice or testing of the present invention, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

Figure 1:
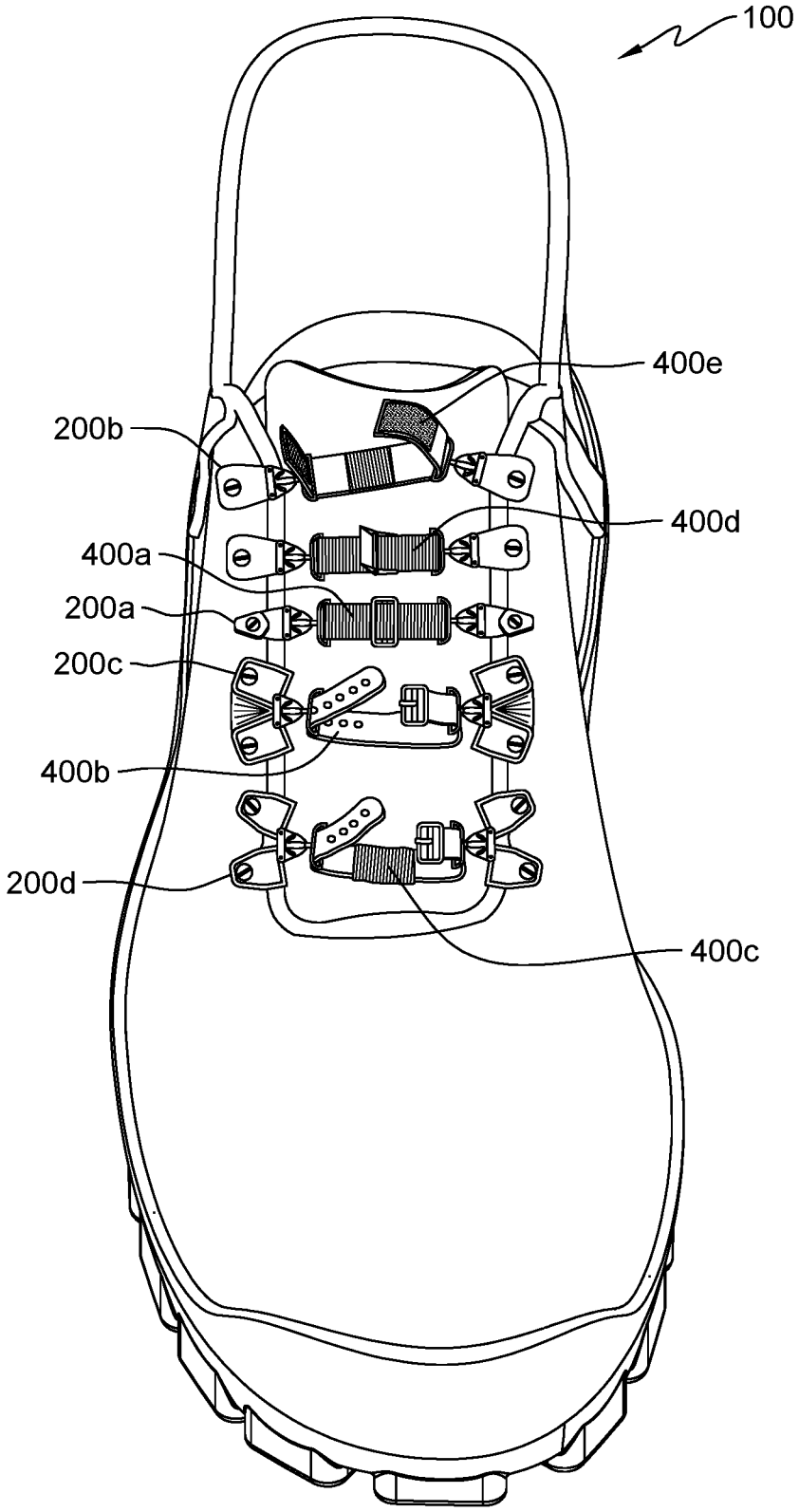
FIG. 1 depicts front view of a boot with a plurality of fastening system 1*s* installed, in accordance with one embodiment of the present invention.

FIG. 1 depicts a front view of a boot 100 with a plurality of fastening system 1*s* attached to the boot 100, in accordance with one embodiment of the present invention. As depicted in FIG. 1, the boot 100 has a plurality of different fastening system 1*s* installed. Several of the fastening system 1*s* are attached to the boot 100 via a single anchor 200*a* and 200*b*, and the remainder of the fastening system 1*s* 200 are attached to the boot 100 via a double anchor 200*c* and 200*d*.

The boot 100 may be, any footwear that has a plurality of eyelets which are designed for laces or other string fastening system 1*s* to tie the boot 100 so it is tightly fit to the wearers feet. The boot 100 may be replaces with a sneaker, running shoes, dress shoes, casual shoes, or the like.

The fastening system 1 is comprised of an anchor 200*a*-200*d* and a strap assembly 400*a*-400*e* as well as a ball joint (described in figures to follow). The fastening system 1 is designed to transpose the space between two eyelets of the boot 100 to tighten the boot 100 to the wearers foot. In the shown embodiment, the fastening system 1*s* are installed across each pair of eyelets and are substantially parallel to one another. In additional embodiments, the fastening system 1*s* may overlap, crisscross, or are installed in various holes of the boot 100. The number of fastening system 1*s* may be altered based on the wearers style and preference.

The anchors 200*a*, 200*b*, 200*c*, and 200*d* are designed to secure the fastening system 1 to the boot 100. In the depicted embodiment, the anchors may be a single style 200*a* and 200*b* or may be a double style 200*c* and 200*d*. The anchor 200*a* and the anchor 200*b* differ in style and look, wherein the anchor 200*a* has a wider design, where the anchor 200*b* has a slimmer design. The anchors may have a variety of shapes, sizes, and styles. The anchor 200*c* and the anchor 200*d* different in that the space between the fastening portions is webbed in anchor 200*c* and in anchor 200*d* there is an open space. In additional embodiments, anchors 200*c* and 200*d* maybe various shapes, sizes, and designs. In additional embodiments, there may be anchors with three or more fasteners. This allows the wearer to various looks and styles as well as have various combinations for the feel and tightness of the boot 100. The single anchors 200*a* and 200*b* provide more opportunity to tighten the boot 100 at more eyelets, while the double anchors 200*c* and 200*d* results in less straps so less control over the tightness of the boot 100.

The strap assemblies 400*a*-400*e* are used to traverse the space between the anchors provide the adjustability to tighten the boot 100 on to the wearer's foot. In the depicted embodiment, there are five different styles of strap assemblies 400. In additional embodiments, there may be more or less different strap assemblies 400*a*-400*e* and additional types of strap assemblies used.

Strap assembly 400*a* is adjusted by the use of a slide. Strap assembly 400*b* is adjusted a plurality of openings in the strap assembly 400*b* with a frame-style buckle that is sized to fit inside the openings. Strap assembly 400*c* is adjustable by a plurality of openings in the strap assembly 400*c* and a frame style buckle that is sized to fit inside the openings and the strap has a predetermined section which has elastic properties to provide a more variable fit. Whereby when the wearer flexes the boot 100 the strap assembly 400*c* stretched to accommodate this, thereby keeping the boot 100 at a more consistent tightness to the wearer. Strap assembly 400*d* is a box frame style buckle, where the buckle has teeth or extensions that protrude through the strap material and when engaged with the strap material lock the buckle in place. Strap assembly 400*e* uses a hook and loop style fastener. Various of means of locking the strap in place may be employed. For example, the locking mechanism could be plate style buckle, a clamp style buckle, a hook and loop style buckle, or the like. The strap may be a variety of lengths and thicknesses depending on the size of the boot 100 and the preference of the wearer. For example, the strap may have a larger width if the two-prong anchor 400*c* and 400*d* are used.

The strap itself may be made from various types of cloth or material. In some embodiments, the material may be leather, cotton, wool, denim, nylon, polyesters, elastics, elastane, flannel, rayon, bamboo, hemp, or a combination of various materials in a single strap.

Figure 2:
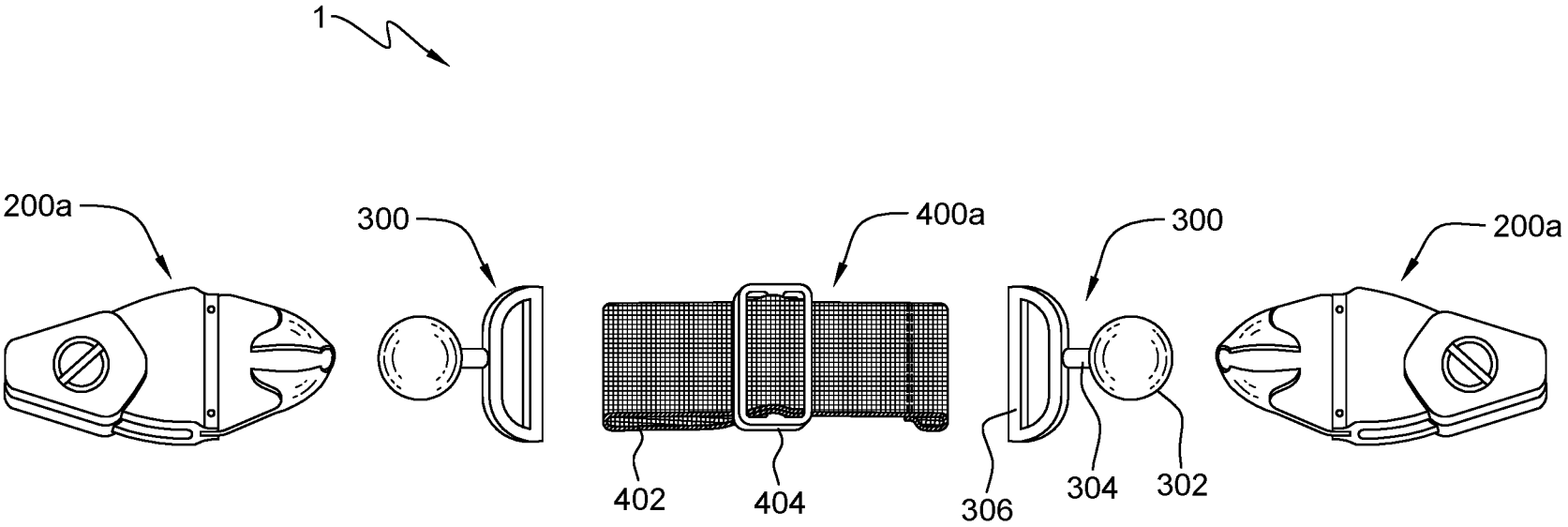
FIG. 2 depicts an exploded view of the fastening system 1, in accordance with one embodiment of the present invention.

FIG. 2 depicts an exploded view of the fastening system 1, in accordance with one embodiment of the present invention. The fastening system 1 is comprised of an anchor (shown is anchor 200*a* but may be replaced with the additional embodiments of the anchor), ball joint 300, and strap assembly 400*a*; which is comprised of strap 402 and a slide 404 (other embodiments of the strap assemblies may be used to replace strap assembly 400*a*). In the depicted embodiment, the anchor 200*a* is used on both sides of the strap assembly 400*a*. In additional embodiments, various anchors may be used on one or both ends of the strap assembly 400*a*.

The ball joints 300 are designed to have a sphere 302 attached to a loop 306 via a rod 304. The sphere 302 may be a variety of shapes provided that the anchor is able to receive the sphere 302. For example, the sphere 302 may be a cube, an octahedron, a prism a cone, or various other three dimension shapes. The rod 304 is sized so that the sphere 302 extends a predetermined distance from the loop 306 so that, the sphere 302 may engage with the anchor without the loop 306 interfering. The diameter of the rod 304 is also sized to fit within the groove in the anchor. In some embodiments, the loop 306 is permanently attached to the strap 402. In additional embodiments, the loop 306 is removable from the strap 402. In the depicted embodiment, the same anchors 200*a* and ball joints 300 are used. In additional embodiments, a variety of ball joins 300 and anchors may be used when assembling the fastening system 1

In the depicted embodiment, the ball joint 300 is made from steel. In additional embodiments, the ball joint may be made from various metals such as aluminum, brass, bronze, various types of steel, plastics such as polyester, polyethylene terephthalate, polyethylene, high density polyethylene, polyvinyl chloride, poly carbonate, polypropylene, or a composite material.

Figure 3:
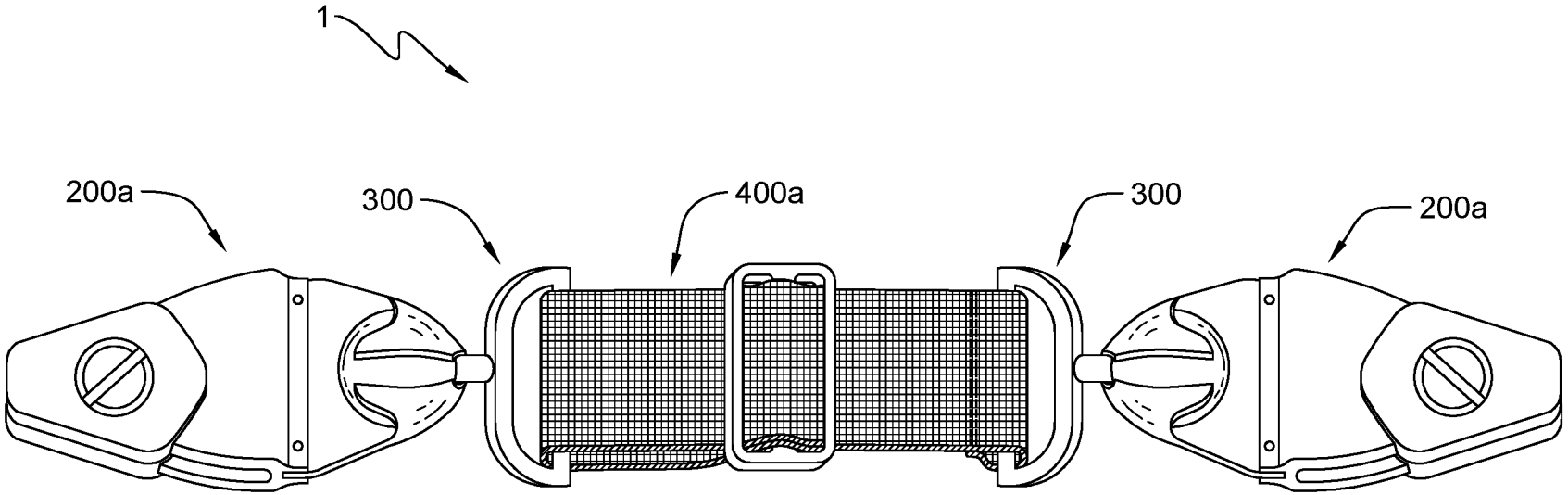
FIG. 3 depicts a top view of the fastening system 1, in accordance with one embodiment of the present invention.

FIG. 3 depicts a top view of the fastening system 1, in accordance with one embodiment of the present invention. In the depicted embodiment, the ball joint 300 is inserted into the anchor 200*a*. This shows how the sphere 302 fits within the grooved portion of the anchor 200*a* and how the grooved portion of the anchor 200*a* is sized to fit the rod 304 of the ball joint 300. The anchor 200*a* is sized and shaped to receive the sphere 302 of the ball joint 300. Once engaged the sphere 302 is secured in the anchor and is designed to remain engaged through the activity level of the wearer. However, these fastening system 1*s* may be easily disengaged even with minimal dexterity.

Figure 4:
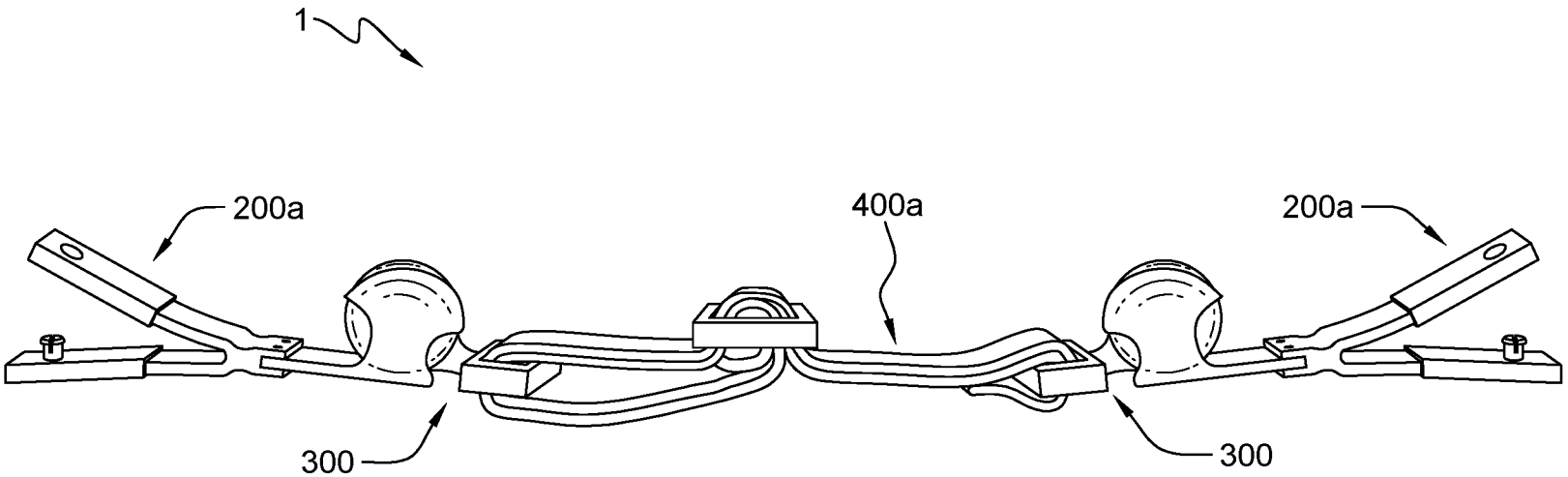
FIG. 4 depicts a side view of the fastening system 1, in accordance with one embodiment of the present invention.

FIG. 4 depicts a side view of the fastening system 1, in accordance with one embodiment of the present invention. In the depicted embodiment, the ball joint 300 is inserted into the anchor 200*a*. This shows how the sphere 302 fits within the grooved portion of the anchor 200*a* and how the grooved portion of the anchor 200*a* is sized to fit the rod 304 of the ball joint 300. The anchor 200*a* is sized and shaped to receive the sphere 302 of the ball joint 300. The side view shows how the sphere 302 is secured on a substantial portion of the surface of the sphere 302. In the depicted embodiment, the grooved portion of the anchor 200*a* is curved to substantially mimic the surface of the sphere 302 to create a more secure fit. The grooved portion of the anchor 200*a* may be sized and shaped to receive the various shapes of the sphere 302.

Figure 5:
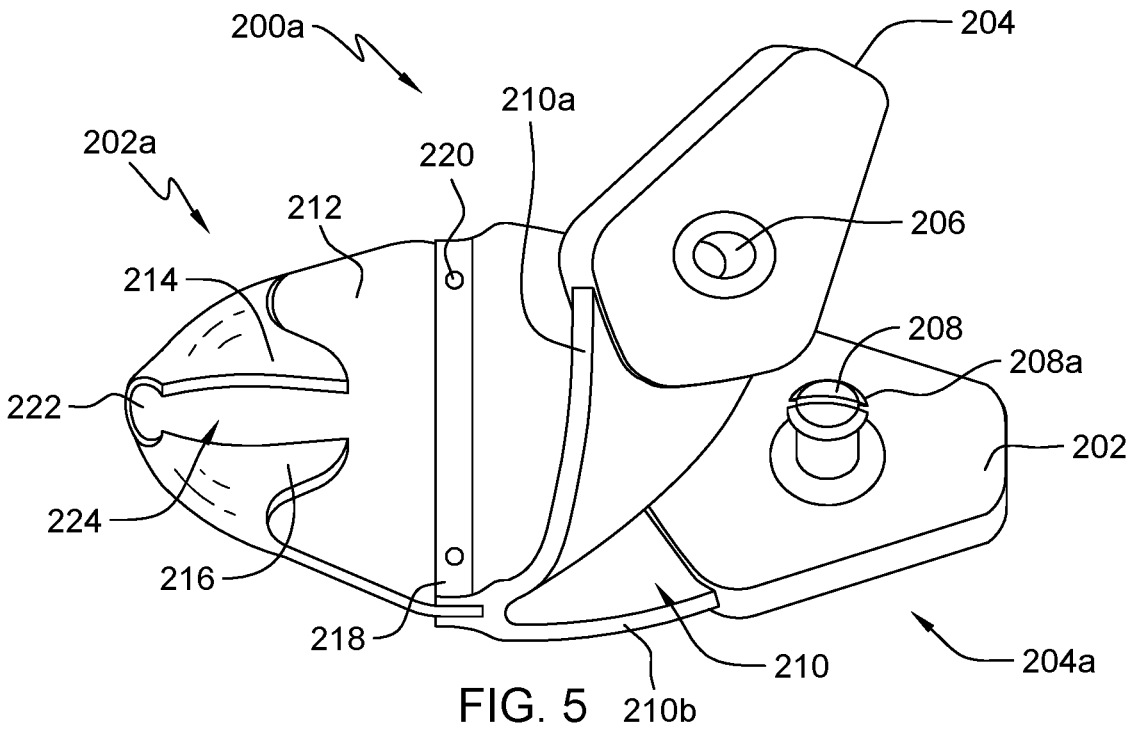
FIG. 5 depicts a top view of an anchor, in accordance with one embodiment of the present invention.

FIG. 5 depicts a top view of the anchor 200*a*, in accordance with one embodiment of the present invention. The anchor 200*a* is comprised of two sections, the grooved section 202*a* and the attachment section which are connected along a center portion 218 of the attachment section. In the depicted embodiments, the two sections are held together by pins 220. In additional embodiments, the two sections may be held together by welding, crimping, or they may be a unitary design.

The grooved section 202*a* is comprised of a substantially flat section 212. The end of the flat section 212 which is not attached to the attachment section is curved to form a first locking portion 214 and a second locking portion 216. The locking portions 214 and 216 are curved and bent to create a gap 224 which leads into an opening 222. As depicted in the previous figures, this gap 224 and opening 222 are sized and shaped to receive the sphere 302 and are sized to fit the rod 304. The shape which the locking portions 214 and 216 is dependent upon the shape of the sphere 302 which is inserted.

In additional embodiments, the grooved section 202*a* instead of having the folded members has a closed loop the extends the length of anchor parallel to the center portion. The sphere 302 of the ball joint 300 is a hook, which is sized to connect with the closed loop. In additional embodiments, the sphere 302 is replaced with a spring-loaded clasp which slides into the closed loop and once passes a specific distance the spring-loaded clasp engages the closed loop.

The attachment section is comprised of a piece of flexible material 210 which is attached to the center portion 218 substantially in the middle of the piece of flexible material 210 to create two even portions of the material overlapping one another forming a top member 210*a* and a bottom member 210*b*. In the depicted embodiment, the top member 210*a* has a cover 204 which has an opening 206 set in a predetermined location. The lower member 210*b* has an end cap 202 with a protrusion 208 extending towards the top member 210*a*. The protrusions 208 is positioned so that the protrusion 208 is able to be inserted into the opening 206 in the top member 201*a*. The protrusion 208 is sized to extend a predetermined distance through the opening 206 so that the protrusion 208 may extend through the thickness of the boot 100 material and pass through the thickness of the end cap 204 and lock. The protrusion is a split end peg with an engagement lip that is sized to fit through the opening 206 but expands and locks in place once the engagement lip of the protrusion passes through the opening 206. In additional various other fastening means, may be used such as buttons, clips, clasps, pins, pegs, bumpers, split drive pins, or other detachable fastening means.

The flexible material 210 may be made from, but not limited to, leather, cotton, wool, denim, nylon, polyesters, elastics, elastane, flannel, rayon, bamboo, hemp, or a combination of various materials.

The end cap 204 and 202 may be made from, but not limited to, various metals such as aluminum, brass, bronze, various types of steel, plastics such as polyester, polyethylene terephthalate, polyethylene, high density polyethylene, polyvinyl chloride, poly carbonate, polypropylene, or a composite material.

The grooved section 202*a* may be made from, but not limited to, various metals such as aluminum, brass, bronze, various types of steel, plastics such as polyester, polyethylene terephthalate, polyethylene, high density polyethylene, polyvinyl chloride, poly carbonate, polypropylene, or a composite material.

Figure 6:
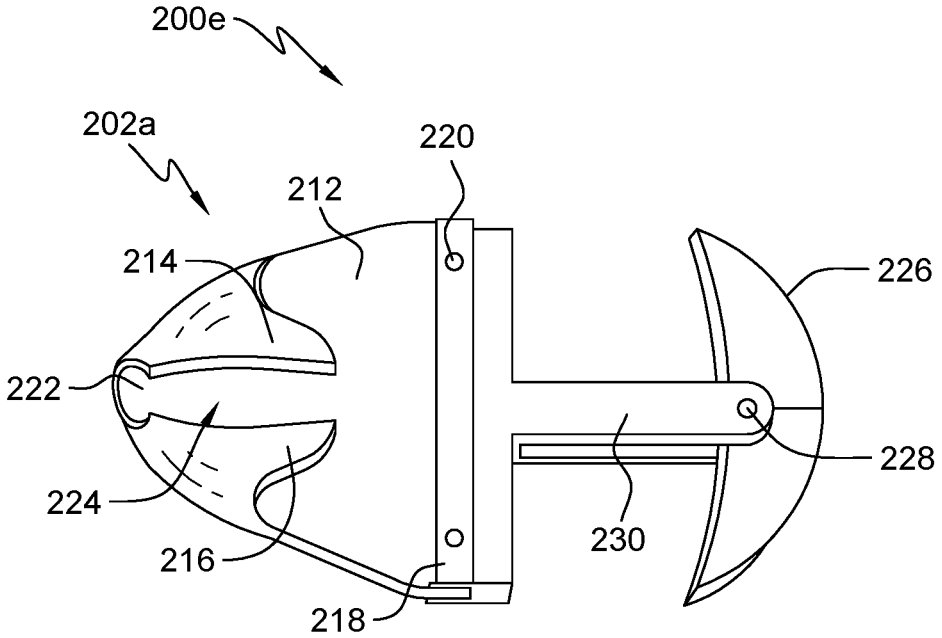
FIG. 6 depicts a top view of an anchor, in accordance with another embodiment of the present invention.

FIG. 6 depicts a top view of an anchor 200*e*, in accordance with another embodiment of the present invention. A similar grooved section 202*a* is employed, but the attachment section is an additional embodiment. The attachment section is comprised of a T-lock which is comprised of a center member 230 attached to a cross member 226 via a pin 228. The pin 228 allows the cross member 226 to rotate and the center member 230 and the cross member 226 are sized to fit through the eyelet of the boot 100. When installed the cross member 226 locking the fastening system 1 in place. The cross member 226 is designed to rotate about the pin and fit within the gap present in the center member 230 so that the members are substantially parallel with one another and would be sized to fit through the eyelet of a boot 100.

The center member 230 and the cross member 226 may be made from, but not limited to, various metals such as aluminum, brass, bronze, various types of steel, plastics such as polyester, polyethylene terephthalate, polyethylene, high density polyethylene, polyvinyl chloride, poly carbonate, polypropylene, or a composite material.

Figure 7:
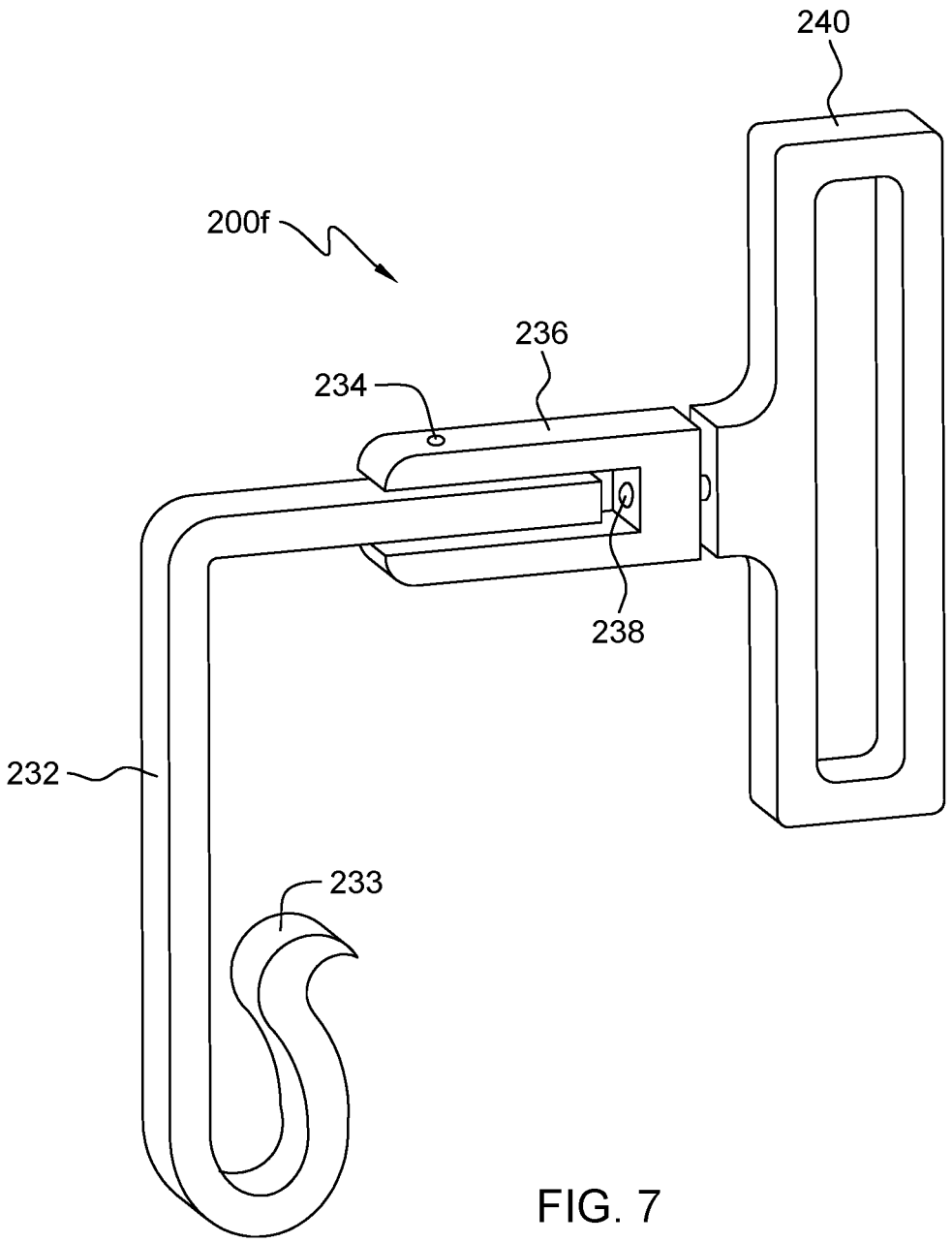
FIG. 7 depicts a top view of an anchor, in accordance with yet another embodiment of the present invention.

FIG. 7 depicts a top view of an anchor 200*f*, in accordance with yet another embodiment of the present invention. This anchor is designed for a boot 100 where there is no eye lets, but instead has a closed loop which the laces would pass through. The anchor 200*f* is comprised of a curved locking member 233, an adjustment member 236 attached to the curved locking member 233 via a rotatable pin, and a strap lock 240 attached to the adjustment member 236 via a rotatable pin. The strap lock 240 attaches directly to the strap which is used and is able to rotate to adjust for the wearer walking and flexing the show. The curved locking member 230 is designed to have a straight section which curves up into portion 233. The curved portion 233 presses against the straight section of the curved locking member 230 to keep the loop of the boot 100 from disengaging. In additional embodiments, the strap lock 240 may be replaced with a grooved section 202*a*.

The strap lock 240, the adjustment member 236, pins 234 and 238, and the curved locking member 233 may be made from, but not limited to, various metals such as aluminum, brass, bronze, various types of steel, plastics such as polyester, polyethylene terephthalate, polyethylene, high density polyethylene, polyvinyl chloride, poly carbonate, polypropylene, or a composite material.

Figure 8:
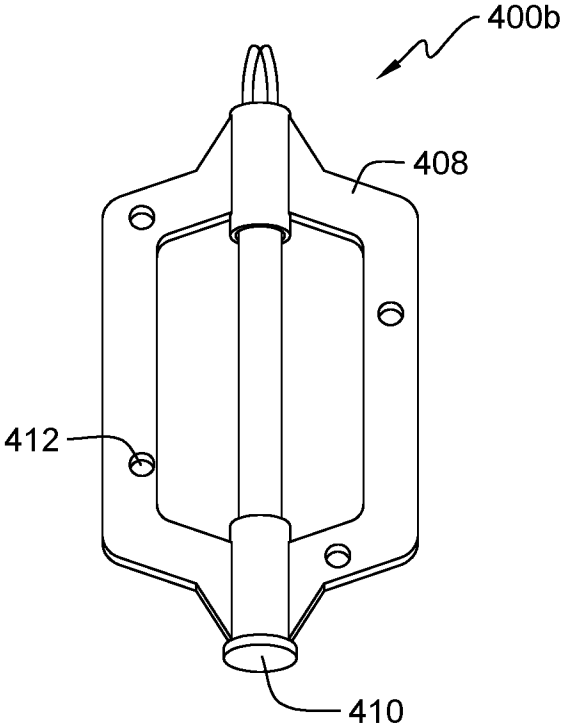
FIG. 8 depicts a top view of a buckle, in accordance with another embodiment of the present invention.

FIG. 8 depicts a top view of a buckle 404*b*, in accordance with another embodiment of the present invention. The buckle 404*b* is comprised of a central pin 410 and a looped member 408. The pin passes through a plurality of openings in the looped member 408 to create the buckle. The looped member 408 has a plurality of openings 412 positioned in predetermined locations and are of predetermined sizes. Various types of buckles, or clasps may be used provided they have the openings 412.

Figure 9:
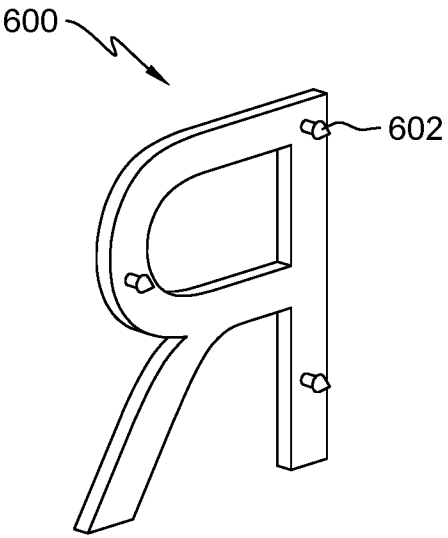
FIG. 9 depicts the rear view of a charm, in accordance with an embodiment of the present invention.

FIG. 9 depicts the rear view of a charm 600, in accordance with an embodiment of the present invention. The charm 600 may be a variety of pictures, letters, numbers, emblems, shapes, sizes, or the like. On the rear side of the charm 600 are at least one pin 602 which is sized and shaped to engage and lock with the openings 412 of the buckle 404*b*. They are designed to be disengageable with the buckle 404*b* so that the charm 600 can be removed and replaced at the wearers discretion.

Figure 10:
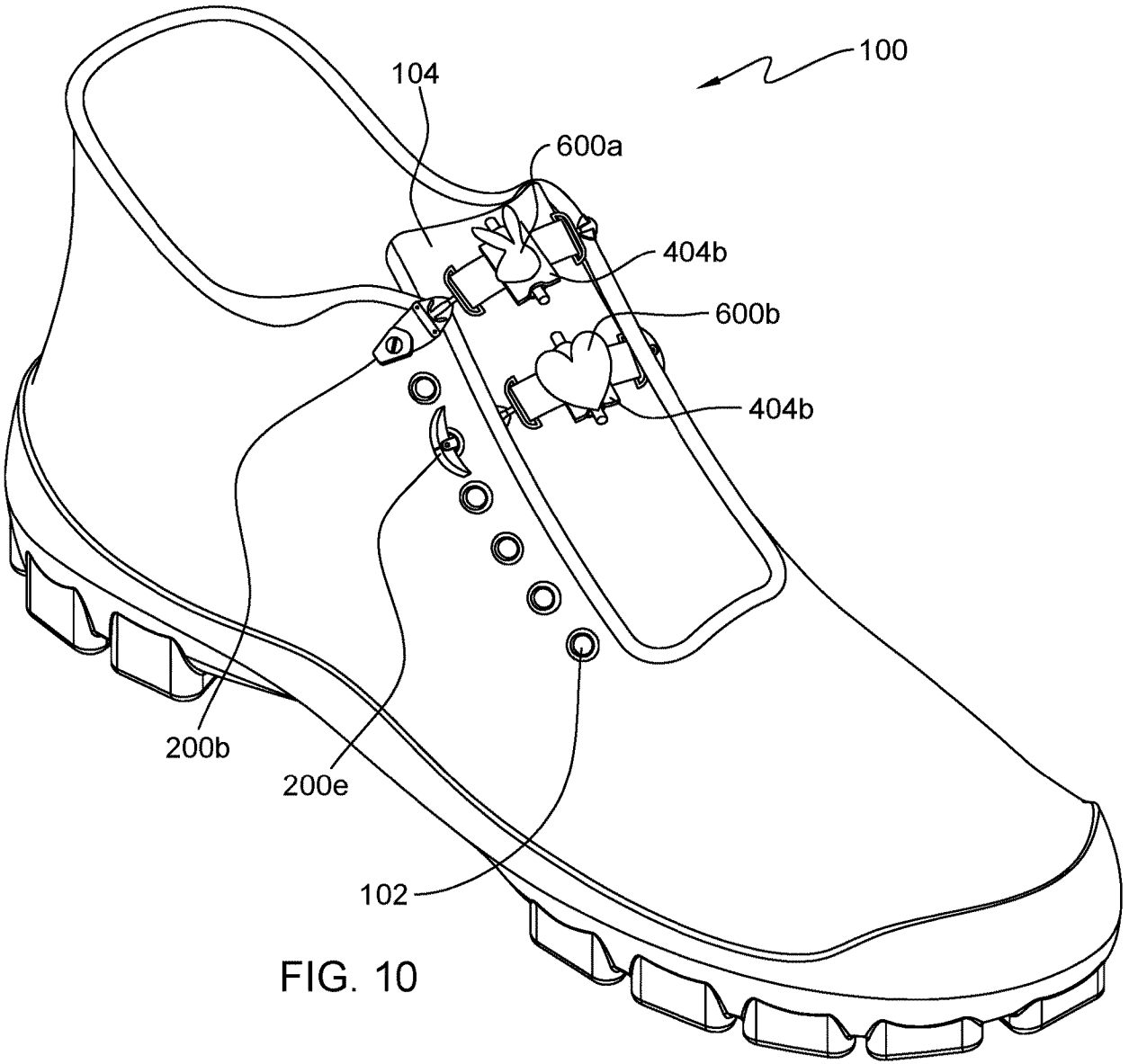
FIG. 10 depicts an isometric view of the boot, in accordance with one embodiment of the present invention.

FIG. 10 depicts an isometric view of the boot 100, in accordance with one embodiment of the present invention. In the depicted embodiment, various fastening systems 1 are shown employing anchors 200*b* and 200*e*. This shows how the two different anchors are attached through the eyelets 102 of the boot 100. Additionally, various buckles are shown on the strap with various charms attached to the buckles.

The process of manufacturing and installing the fastening system 1 200 is highlighted throughout this Specification, in the Figures and in the steps below. And while the below does illustrate one method of installing the fastening system 1 200, based on the various types of bands 402, latches, and means of tightening. Portions of these steps may be modified to adjust to this.

First step is to take the anchor 202 and insert the pin 208 through the hole in the boot 100. Once the pin 212 is through the hole and a portion of the pin 208 is exposed above the top of the surface of the boot 100. The cover 206 of the anchor 202 is then secured over the pin 208 so that the pin 208 passes through the opening in the cover 206. Once the pin 208 passed through the opening the anchor is in the locked position. To unlock the anchor 202 reverse these steps.

The latches on each of the strap 300 are placed within the groove of the anchors so that the latches fit securely within the groove. In some embodiments, the latch is designed to snap fit into the groove so that there is an audible and physical cue that the latch is properly inserted into the groove.

Once both latches are inserted into the grooves of the anchors 202, the wearer will adjust the band 102 to the desired tightness via the prescribed method of tightening based on the type of band 306. In some instances, the band 402 is elastic and there is no need to tighten the band 102 as it will automatically retract to its original size.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A shoe fastening system designed to removably engage eyelet holes of a shoe for tightening the shoe around a wearer's foot, the shoe fastening system comprising:

an anchor, wherein the anchor is comprised of, a grooved member having a first end configured to house a ball of a ball joint with a groove configured to receive a rod of the ball joint and a second end, and an eyelet hole protrusion member having a first end and a second end, the first end of the eyelet hole protrusion member permanently and non-releasably connected to the second end of the grooved member at a center portion of the anchor, the eyelet hole protrusion member comprising a top member of flexible material and a lower member of flexible material that each connect to the center portion of the anchor, the lower member of flexible material includes an upward protrusion member, the top member of flexible material includes a first opening, wherein the upward protrusion member is configured to connect to the opening, and is configured to releasably lock the anchor to the eyelet hole of the shoe at a location away from the center portion;

an attachment member having a first end with the rod and the ball of the ball joint and a second end, wherein the rod and ball are sized to removably engage with the groove of the grooved member and the second end of the attachment member has a closed loop;

a strap, wherein the strap is a predetermined length and width and is sized to fit through the closed loop of the attachment member;

a locking mechanism designed to restrain the strap;

wherein the first end of the grooved member of the anchor comprises a first locking portion and a second locking portion that are curved and bent to create a gap which leads into a second opening, wherein the first locking portion and the second locking portion engage with the ball of the attachment member to form the ball joint with the groove between and edge of the first locking portion and an edge of the second locking portion, and wherein the shoe fastening system is capable of tightening the shoe around the wearer's foot.

2. The shoe fastening system of claim 1, wherein the locking mechanism is a buckle with teeth or extensions that protrude through the strap, the strap has a plurality of openings in predetermined locations used by the teeth or the extensions for locking the strap in place and adjusting the amount of useable strap between the closed loop of the attachment member and a closed loop of a second attachment member, and the strap has an elastic or elastane section.

3. The shoe fastening system of claim 1, further comprising a charm with a front side and a rear side, wherein the charm has a plurality of protrusions on the rear side in predetermined positions and predetermined lengths.

4. The shoe fastening system of claim 3, wherein the protrusions of the charm are positioned to coincide with a plurality of openings of the locking mechanism, and wherein the charm detachably engages with the locking mechanism.

5. The shoe fastening system of claim 1, wherein the locking mechanism is a hook and loop fastener and is integrated into the strap, and the strap further comprises an elastic or elastane section.

6. The shoe fastening system of claim 1, wherein the first locking portion and the second locking portion are shaped to include a looking portion opening at a distal end of the groove member groove from the eyelet hole protrusion member, the locking portion opening sized to fit the rod and the first locking portion and the second locking portion are sized to receive the ball.

7. The shoe fastening system of claim 1, wherein the ball is a non-spherical shape.

8. The shoe fastening system of claim 1, comprising an additional attachment member and an additional anchor, wherein the attachment member is attached to the strap and the additional attachment member is attached to the anchor.

9. The shoe fastening system of claim 8, further comprising another additional anchor connected to each attachment member, wherein each anchor corresponds to a different eyelet location.

10. A shoe containing the shoe fastening system of claim 8.

11. The shoe fastening system of claim 1, wherein the eyelet hole protrusion member has a split end peg or a split drive pin for removably fastening the top member to the lower member.

12. A footwear component, comprising:

an anchor comprised of, a grooved member having a first end configured to house a ball of a ball joint with a groove configured to receive a rod of the ball joint and a second end, a first flap having a first end and a second end, the first end of the first flap permanently and non-releasably connected to the second end of the grooved member at a center portion of the anchor, and a second flap having a first end and a second end, the first end of the second flap non-releasably connected to the first end of the first flap and the second end of the grooved member at the center portion of the anchor, wherein the first flap includes an upward protrusion member and the second flap includes a first opening, wherein the upward protrusion member is configured to connect to the first opening and is configured to releasably lock the anchor to the eyelet hole of the shoe; and an attachment member comprising a first end with the rod and the ball of the ball joint and a second end with a closed loop, wherein the rod and ball are sized to removably engage with the groove of the grooved member;

a strap, wherein the strap is a predetermined length and width and is sized to fit through the closed loop of the attachment member; and a locking mechanism designed to restrain the strap;

wherein the first end of the grooved member of the anchor comprises a first locking portion and a second locking portion that are curved and bent to create a gap which leads into a second opening, wherein the first locking portion and the second locking portion engage with the ball of the attachment member to form the ball joint with the groove between an edge of the first locking portion and an edge of the second locking portion, and wherein the footwear component is capable of tightening a shoe around a wearer's foot.

13. The shoe fastening system of claim 12, wherein the locking mechanism is a hook and loop fastener and is integrated into the strap, and the strap further comprises an elastic or elastane section.

14. The footwear component of claim 12, wherein the locking mechanism is a buckle with teeth or extensions that protrude through the strap, the strap has a plurality of openings in predetermined locations used by the teeth or the extensions for locking the strap in place and adjusting the amount of useable strap between the closed loop of the attachment member and a closed loop of a second attachment member, and the strap has an elastic or elastane section.

15. The footwear component of claim 12, wherein one of the first flap or the second flap has a split end peg or a split drive pin for removably fastening the first flap to the second flap at the second connection.

16. The footwear component of claim 12, wherein the first locking portion and the second locking portion are shaped to include a locking portion opening at a distal end of the groove member groove from the eyelet hole protrusion member, the locking portion opening sized to fit the rod and the first locking portion and the second locking portion are sized to receive the ball.

17. A shoe containing a footwear component, wherein the footwear component is comprising:

an anchor comprised of, a grooved member having a first end configured to house a ball of a ball joint with a groove configured to receive a rod of the ball joint and a second end, a first flap having a first end and a second end, the first end of the first flap permanently and non-releasably connected to the second end of the grooved member at a center portion of the anchor, and a second flap having a first end and a second end, the first end of the second flap non-releasably connected to the first end of the first flap and the second end of the grooved member at the center portion of the anchor, wherein the first flap includes an upward protrusion member and the second flap includes a first opening, wherein the upward protrusion member is configured to connect to the first opening and is configured to releasably lock the anchor to the eyelet hole of the shoe; and an attachment member comprising a first end with the rod and the ball of the ball joint and a second end with a closed loop, wherein the rod and ball are sized to removably engage with the groove of the grooved member;

a strap, wherein the strap is a predetermined length and width and is sized to fit through the closed loop of the attachment member; and a locking mechanism designed to restrain the strap;

wherein the first end of the grooved member of the anchor comprises a first locking portion and a second locking portion that are curved and bent to create a gap which leads into a second opening, wherein the first locking portion and the second locking portion engage with the ball of the attachment member to form the ball joint with the groove between an edge of the first locking portion and an edge of the second locking portion, and wherein the footwear component is capable of tightening the shoe around a wearer's foot.

* * * * *